US005950878A

United States Patent [19]

Wade et al.

[11] Patent Number: 5,950,878

[45] Date of Patent: Sep. 14, 1999

[54] DISPENSING TUBE VALVE ASSEMBLY

[75] Inventors: Allan E. Wade, Ballwin, Mo.; Keith D. Alsberg, Chicago, Ill.; Jon B. Taylor, Chicago, Ill.; David C. Brown, Chicago, Ill.

[73] Assignee: Steris Corporation, Mentor, Ohio

[21] Appl. No.: 08/905,911

[22] Filed: Aug. 4, 1997

[51] Int. Cl.[6] ..... B65D 37/00

[52] U.S. Cl. ..... 222/207; 222/212; 222/494

[58] Field of Search ..... 222/207, 212, 222/494

[56] References Cited

U.S. PATENT DOCUMENTS

| | | | |
|---|---|---|---|
| 1,206,661 | 11/1916 | Booth . | |
| 1,607,993 | 11/1926 | Loewy . | |
| 1,709,948 | 4/1929 | Proctor | 222/494 |
| 1,748,682 | 2/1930 | Smith . | |
| 1,825,553 | 9/1931 | Smith . | |
| 1,925,926 | 9/1933 | Kunkel | 222/494 |
| 1,989,145 | 1/1935 | Newby . | |
| 1,989,714 | 2/1935 | Statham . | |
| 2,005,642 | 6/1935 | Thornton . | |
| 2,025,810 | 12/1935 | Dinnes | 222/494 |
| 2,094,700 | 10/1937 | Gunn . | |
| 2,122,299 | 6/1938 | Sloan . | |
| 2,175,052 | 10/1939 | Bull et al. . | |
| 2,591,354 | 4/1952 | Harris . | |
| 2,644,663 | 7/1953 | Klingler . | |
| 2,679,954 | 6/1954 | Barnes . | |
| 2,688,979 | 9/1954 | Kendrick . | |
| 2,720,881 | 10/1955 | Jones . | |
| 2,758,755 | 8/1956 | Schafler . | |
| 2,802,607 | 8/1957 | Kalmbach, Jr. et al. . | |
| 2,937,795 | 5/1960 | Peras . | |
| 2,942,762 | 6/1960 | Fahr . | |
| 3,111,703 | 11/1963 | Kaufman . | |
| 3,165,241 | 1/1965 | Curry . | |
| 3,179,301 | 4/1965 | Lucht . | |
| 3,342,379 | 9/1967 | Foley . | |
| 3,490,488 | 1/1970 | Grist . | |
| 3,602,407 | 8/1971 | Grothoff | 222/494 |
| 3,669,323 | 6/1972 | Harker et al. . | |
| 3,674,183 | 7/1972 | Venable et al. . | |
| 3,685,700 | 8/1972 | Martin | 222/494 X |
| 3,726,436 | 4/1973 | Despain et al. | 222/494 X |
| 3,795,558 | 3/1974 | Dabney et al. . | |
| 3,921,630 | 11/1975 | McPhee . | |
| 4,036,412 | 7/1977 | Craig | 222/494 X |
| 4,057,177 | 11/1977 | Laauwe | 222/493 X |
| 4,088,166 | 5/1978 | Miller | 222/107 X |
| 4,133,457 | 1/1979 | Klassen | 222/494 X |
| 4,166,553 | 9/1979 | Fraterrigo | 222/207 X |
| 4,269,330 | 5/1981 | Johnson | 222/494 X |
| 4,408,702 | 10/1983 | Horvath | 222/212 X |
| 4,434,810 | 3/1984 | Atkinson . | |
| 4,470,523 | 9/1984 | Spector | 222/181 |
| 4,478,356 | 10/1984 | Roggenburg, Jr. et al. | 222/494 X |
| 4,616,768 | 10/1986 | Flier | 222/490 X |

(List continued on next page.)

*Primary Examiner*—Kenneth Bomberg
*Attorney, Agent, or Firm*—Fay, Sharpe, Beall, Fagan, Minnich & McKee, LLP

[57] ABSTRACT

A dispensing valve assembly for dispensing a fluid product and preventing air from being drawn into the fluid product through the valve includes a flexible diaphragm valve (10, 50, 100) and a valve seat insert (12, 58, 102). The flexible diaphragm valve flexes from a concave closed position to a convex open position in which fluid product is dispensed through a dispensing opening (26, 56, 116) in the diaphragm. The valve seat insert is positioned adjacent an inside surface of the diaphragm valve in its closed position to prevent the valve from buckling inward and prevent air from passing into the fluid product through the valve.

15 Claims, 7 Drawing Sheets

U.S. PATENT DOCUMENTS

| | | | |
|---|---|---|---|
| 4,620,648 | 11/1986 | Schwartzman | 222/490 |
| 4,646,945 | 3/1987 | Steiner et al. | 222/207 |
| 4,660,747 | 4/1987 | Borg et al. | 222/494 X |
| 4,699,300 | 10/1987 | Blake | 222/494 |
| 4,728,006 | 3/1988 | Drobish et al. | 222/494 X |
| 4,747,518 | 5/1988 | Laauwe | 222/494 X |
| 4,747,519 | 5/1988 | Green et al. | 222/181 |
| 4,749,108 | 6/1988 | Dornsbusch et al. | 222/494 X |
| 4,779,766 | 10/1988 | Kinsley | 222/153 |
| 4,798,311 | 1/1989 | Workum | 222/212 X |
| 4,928,861 | 5/1990 | Schiemann | 222/481.5 |
| 4,932,114 | 6/1990 | Morse et al. . | |
| 4,987,740 | 1/1991 | Coleman . | |
| 4,991,745 | 2/1991 | Brown | 222/212 |
| 5,033,655 | 7/1991 | Brown | 222/212 |
| 5,071,017 | 12/1991 | Stull | 222/494 X |
| 5,115,950 | 5/1992 | Rohr | 222/494 X |
| 5,186,368 | 2/1993 | Garcia | 222/494 X |
| 5,203,470 | 4/1993 | Brown | 222/105 X |
| 5,213,236 | 5/1993 | Brown et al. | 222/212 X |
| 5,271,531 | 12/1993 | Rohr et al. | 222/212 |
| 5,339,995 | 8/1994 | Brown et al. | 222/494 X |
| 5,377,877 | 1/1995 | Brown et al. | 222/212 X |
| 5,379,919 | 1/1995 | Gueret | 222/494 X |
| 5,409,144 | 4/1995 | Brown | 222/212 X |
| 5,439,143 | 8/1995 | Brown et al. | 222/494 X |
| 5,617,978 | 4/1997 | Geier | 222/494 X |

DISPENSING TUBE VALVE ASSEMBLY

BACKGROUND OF THE INVENTION

The present invention pertains to the art of dispensing fluid products and, more particularly, to dispensing of fluid products such as soaps in the medical field.

In the packaging of various fluid products ranging from personal care products such as shampoo, conditioner, toothpaste, lotion, or soap, to food products such as ketchup and mustard, many different packaging designs have evolved. Some increasingly popular packaging designs include automatically operating self-sealing valves which open when a container is squeezed and closed when pressure is released from the container. These types of self-sealing closures are easy to use and provide means for positively closing the valve to prevent accidental dispensing of the product. A wide variety of these automatically operating closures are available. However, many of the self-sealing valve designs suffer from the disadvantages of being difficult to control and/or allowing drips to occur after the pressure to the container has been removed.

The flexible, self-sealing dispensing valves which are currently available for dispensing fluid products such as soaps and shampoos generally include a resiliently deformable valve portion having a discharge orifice which may be formed in a variety of shapes such as a slit or a cross. Deformable valves having a concave shape in the closed position have been found to successfully eliminate dripping. Some examples of these types of valves are illustrated in U.S. Pat. Nos. 4,728,006 and 4,991,745. To use these self-sealing type valves, a flexible container is manually deformed causing the pressure of the fluid product on the valve to deform the flexible valve outward and discharge the fluid product through the dispensing opening in the valve. Once the manual pressure on the flexible container has been removed, the self-sealing valve returns past its original sealed position and opens inwardly allowing air to be sucked back into the container to return the flexible container to an equilibrium position for further dispensing.

In the medical field, various fluid products such as soap which are dispensed must be maintained in a sterile condition. However, with the known self-sealing valves, ambient air flows back into the container of fluid product through the valve after the fluid product is dispensed. This creates a situation in which harmful bacteria or other contaminants present in the air can be introduced to the fluid product and be spread by use of the product. Therefore, in the medical field, it is desirable to provide a dispensing valve which prevents ambient air from entering the container through the valve.

SUMMARY OF THE INVENTION

The present invention contemplates a new and improved dispensing valve assembly which can be used for dispensing fluid products in the medical field and will prevent suckback of air into the fluid product.

In accordance with one aspect of the present invention, a dispensing valve assembly includes a dispensing tube for dispensing a product from a container, a flexible valve having a valve opening for dispensing the fluid product from the dispensing tube, and a suckback preventing valve seat positioned adjacent the valve opening. The valve is positioned within an end of the dispensing tube and is extendable from a concave closed position in which the valve extends into an interior of the dispensing tube to a convex open position to dispense the fluid product from the dispensing tube. The suckback preventing valve seat is positioned adjacent the valve opening at the interior side of the valve opening when the valve is in the closed position and prevents air from being drawn into the dispensing tube through the valve opening.

In accordance with a more limited aspect of the invention, the valve seat includes a projecting portion which extends into the valve opening to seal the valve opening when the valve is in the closed position.

In accordance with another more limited aspect of the present invention, the valve seat is mounted within the dispensing tube by a support structure which allows the fluid product to pass through the support structure and around the valve seat when the valve is in the open position.

In accordance with a further aspect of the present invention, a dispensing container includes a container body having a dispensing opening for dispensing a fluid product, a valve connected to the dispensing opening for controlling a flow of the fluid product from the container body, and a suckback preventing valve seat. The valve includes a flexible valve head with a substantially central orifice. The valve head has a closed position in which the valve head is concave inward and an opened position in which the valve head is convex outward and the fluid product is dispensed through the orifice. The valve moves from the closed position to the opened position under a predetermined head pressure which is greater than a head pressure provided by the container in a full state. The suckback preventing valve seat is positioned adjacent to and seals the valve head orifice when the valve head is in the closed position to prevent air from being drawn into the container.

In accordance with a more limited aspect of the invention, the dispensing container includes an air vent communicating between an interior and an exterior of the container body to allow air to pass into the container to return the container body to an equilibrium state after the fluid product has been dispensed.

In accordance with another more limited aspect of the present invention, the container body is a flexible pouch which collapses as the fluid product is dispensed.

According to a further aspect of the present invention, a dispensing valve assembly preventing air suckback includes a valve member having a supporting ring and a flexible diaphragm valve head with a central valve dispensing opening supported by the supporting ring. The diaphragm valve head has a concave shape with respect to an exterior of the dispensing valve assembly in a relaxed state and buckles to a convex shape to dispense a fluid product through the dispensing opening under a predetermined pressure applied by the fluid product on an inner surface of the diaphragm valve head. The improvement includes a valve seat arranged in the support ring of the valve member and preventing air from passing from the exterior of the dispensing valve assembly into the interior of the dispensing valve assembly after the fluid product has been dispensed.

According to an additional aspect of the present invention, a method of dispensing a fluid product and preventing contamination of the fluid product includes dispensing the fluid product from a container through a dispensing opening of a flexible diaphragm valve by compressing a portion of the container and preventing air from being drawn into the container through the dispensing opening of the diaphragm valve to prevent possible contamination of the fluid product by contaminants present in the air.

One advantage of the present invention is the prevention of contamination of a fluid product contained within a product dispenser by preventing unfiltered air from entering into the dispenser.

Still other advantages and benefits of the invention will become apparent to those skilled in the art upon a reading and understanding of the following detailed description.

BRIEF DESCRIPTION OF THE DRAWINGS

The invention may take form in, various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
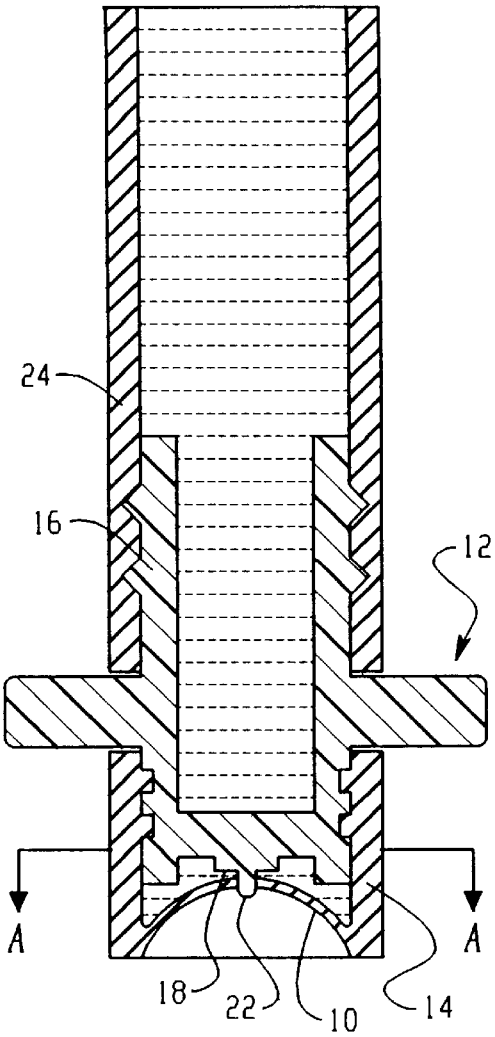
FIG. 1 is a side cross-sectional view of a first embodiment of the invention with the dispensing valve in a closed position.

The FIGURES show several different embodiments of a dispensing valve assembly for dispensing a fluid product in a medical environment where it is important to prevent air from being drawn into a container through the valve assembly to prevent contamination of the fluid product in the container. In general, the dispensing assembly includes a flexible diaphragm valve 10 and a valve seat insert 12 which prevents air from being drawn into an interior of the container to which the valve is attached. Within the following description, like reference numerals will be used to described like elements of the various embodiments of the present invention.

Figure 2:
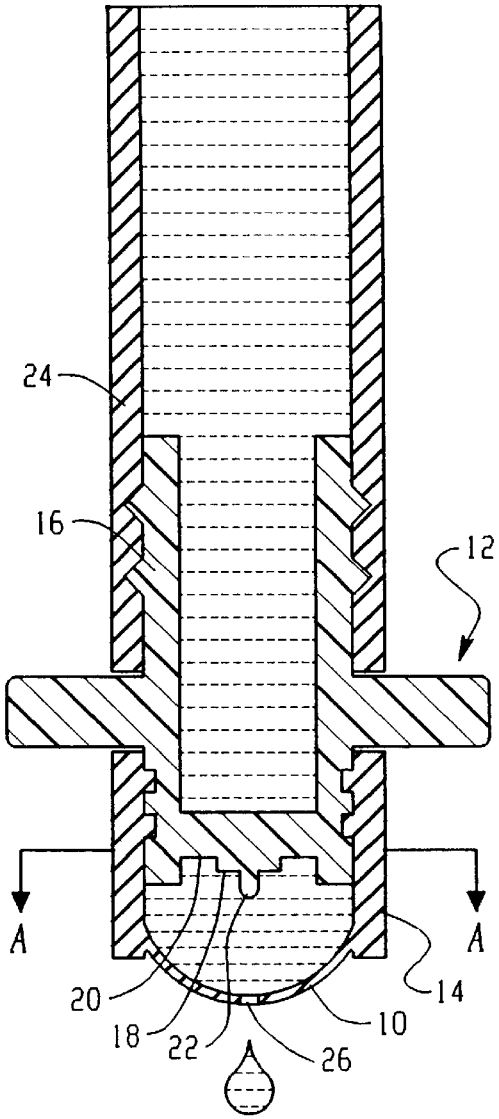
FIG. 2 is a side cross-sectional view of the valve assembly of FIG. 1 with the dispensing valve in an open position.
Figure 3:
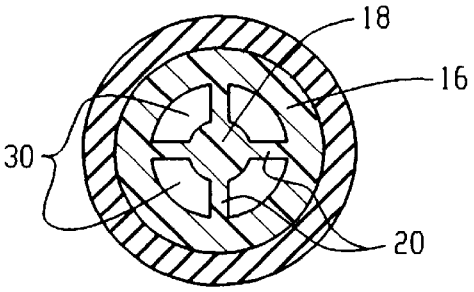
FIG. 3 is a cross-sectional view taken along line A—A of FIG. 1.

One embodiment of the dispensing valve assembly as illustrated in FIGS. 1–3 includes a flexible dome-shaped diaphragm valve 10 which is molded as one piece with a surrounding ring-shaped valve supporting member 14. The valve seat insert 12 has a tubular main body, 16 which fits into and forms a fluid-tight seal with the valve supporting member 14. Supported on the tubular main body 16 of the valve seat insert 12 is the valve seat 18. The valve seat 18 is attached to the main body 16 by axially extending ribs 20 and includes a tapered pin 22 extending from a lower surface of the valve seat. Affixed to a second end of the valve seat insert 12 is a dispensing tube 24 which is formed of a flexible material forming a fluid-tight seal with the valve seat insert 12. The dispensing tube 24 connects the valve 10 to a dispenser or container in which the fluid to be dispensed is stored.

FIG. 1 illustrates the diaphragm valve 10 in a relaxed state which is the state in which the diaphragm valve was molded. In this relaxed state, the valve 10 is dome-shaped and concave with respect to an exterior of the dispensing assembly. The diaphragm valve has a dispensing opening 26 which, in the embodiment of FIG. 1, is circular in shape. In the relaxed state the diaphragm valve 10 is in a closed position where the opening 26 in the diaphragm valve is sealed by the tapered pin 22 of the valve seat 18. When pressure is applied either to the dispensing container or to the dispensing tube 24 connecting the dispensing container to the valve, fluid pressure is applied to an inner surface of the diaphragm valve 10 causing the diaphragm valve 10 to rapidly buckle over to the convex shape illustrated in FIG. 2. The fluid product is dispensed through the dispensing opening 26 when the valve is buckled outward to the convex shape. The diaphragm valve 10 has only two stable states, a first state being illustrated in FIG. 1 when the diaphragm valve is in a closed position, and a second state being illustrated in FIG. 2 when the diaphragm valve is in an open position. In the first or closed state the diaphragm valve 10 is able to support the head pressure applied by a full container of fluid product without buckling to the open position.

As illustrated in FIG. 3, the valve seat insert 12 includes openings 30 between the axial ribs 20 which support the valve seat 18. These openings 30 allow the fluid product to pass freely through the valve seat insert 12 from the dispensing container to the diaphragm valve 10. In addition to sealing the valve dispensing opening 26, the valve seat 18 prevents the diaphragm valve 10 from moving inwardly past the position illustrated in FIG. 1. Thus, the valve seat 18 prevents any air from passing into the fluid product through the valve opening 26 and prevents contamination of the fluid product.

Figure 4:
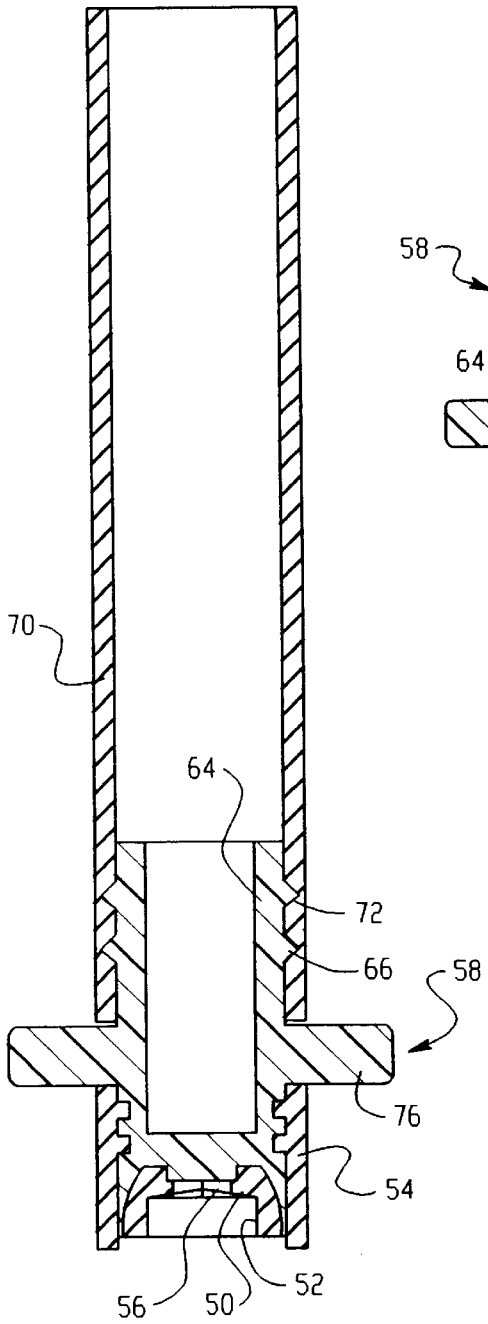
FIG. 4 is a side cross-sectional view of a second embodiment of the invention with the dispensing valve in a closed position.
Figure 5:
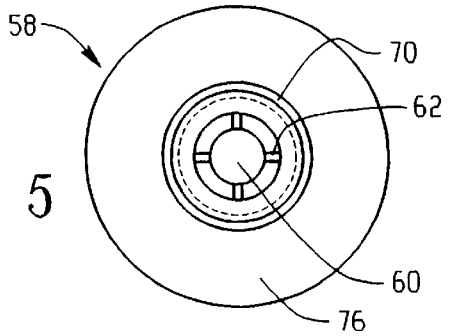
FIG. 5 is a top view of the valve seat insert of FIG. 4.

An alternative embodiment of a dispensing tube and valve assembly is illustrated in FIGS. 4–8. The valve according to this embodiment includes a diaphragm valve head 50 supported by a flexible connector sleeve 52 which connects the valve head to a supporting ring 54. The valve head 50 includes a discharge orifice 56 which is preferably slit-shaped or cross-shaped. Due to this slit-shaped or cross-shaped discharge opening 56 the valve head 50 is completely self-sealing and in the closed position, illustrated in FIG. 4, provides a fluid tight seal.

Figure 6:
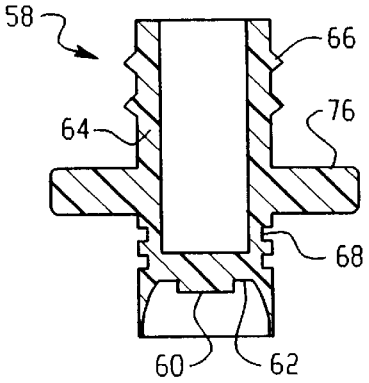
FIG. 6 is a side cross-sectional view of the valve seat insert of FIG. 4.
Figure 7:
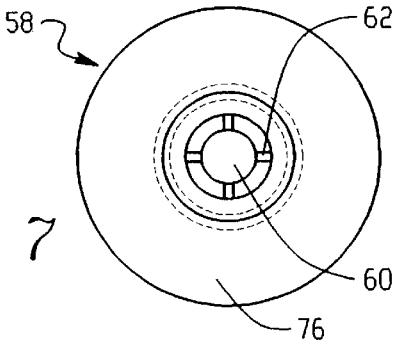
FIG. 7 is a bottom view of the valve seat insert of FIG. 4.
Figure 8:
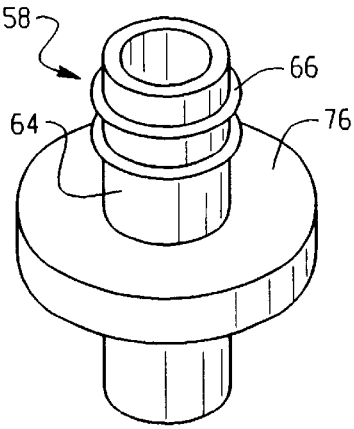
FIG. 8 is a perspective view of the valve seat insert of FIG. 4.

A valve seat insert 58 is inserted into the valve of FIG. 4 to prevent the valve head 50 from moving inward past the closed position illustrated in FIG. 4 and preventing air from passing into the interior of the dispenser to avoid contamination of the fluid product. The valve seat insert 58 as illustrated in FIG. 6 includes a valve seat 60 with a substantially planar lower valve engaging surface. The valve seat 60 is supported by axial ribs 62 inside a substantially cylindrical main body 64. The valve seat insert 58 includes axial ridges 66 and/or grooves 68 for securing the valve seat insert within the valve head 50 and a dispensing tube 70.

Preferably the valve seat insert 58 is formed of a relatively rigid material such as plastic which prevents inward deformation of the valve head 50 past the closed position illustrated in FIG. 4. The valve head 50, the connector sleeve 52, and the supporting ring 54 are preferably molded in one piece from a resilient material such as rubber. When pressure is applied to the valve head 50 by squeezing the dispensing container or the dispensing tube 70, the connector sleeve 52 rolls outwardly away from the valve seat insert 58 allowing the valve head 50 to snap to a convex open position in which fluid product is discharged through the discharge orifice 56. The circumferential external ridges 66 on the valve seat insert 58 engage corresponding grooves 72 in the dispensing tube 70 to form a fluid tight seal. Similarly, the grooves 68 in the lower portion of the valve seat insert 58 engage corresponding ribs 74 of the supporting ring 54 to form a fluid tight seal between the valve seat insert and the supporting ring of the valve. Preferably, the valve seat insert 58 is fixed to the dispensing tube 70 and the supporting ring 54 of the valve by welding or bonding the parts together with a suitable adhesive.

According to one preferred embodiment, the valve seat insert 58 includes a disk-shaped flange 76 extending from the insert around a center portion of the insert. The flange 76 is used to locate the dispensing tube 70 within a dispenser so that the dispensing tube and valve are maintained in a desired position during actuation. The flange 76 also allows the insert 58 and the valve assembly to be easily grasped during and after assembly.

The use of the flexible dispensing tube 70 which is deformed by some type of actuator to dispense the fluid product allows the valve assembly to be connected to different types of containers ranging from fully rigid containers to fully flexible containers such as collapsible bags. Accordingly, although the container configuration and type may vary, the dispensing tube 70 and valve configuration will be designed to fit into the same actuator.

Figure 9:
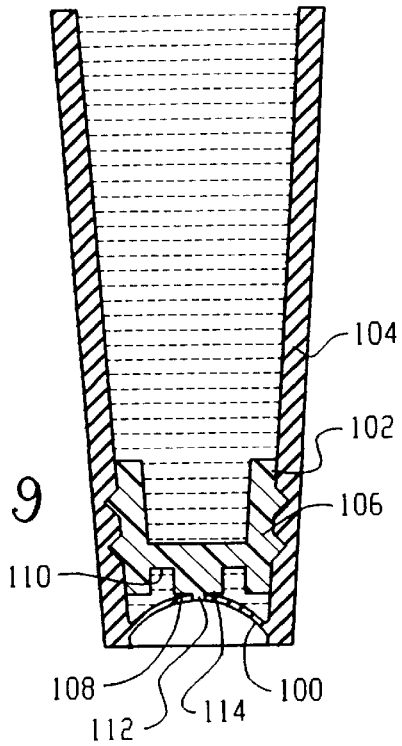
FIG. 9 is a side cross-sectional view of a third embodiment of the present invention with the dispensing valve in a closed position.
Figure 10:
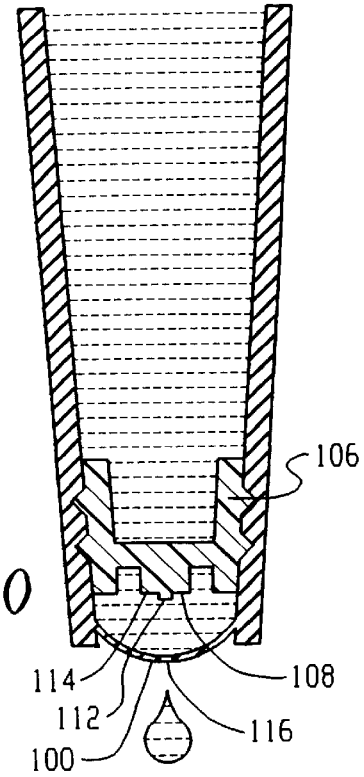
FIG. 10 is a side cross-sectional view of the dispensing valve assembly of FIG. 9 with the dispensing valve in an open position.

FIGS. 9 and 10 illustrate an alternative embodiment of a dome-shaped diaphragm valve 100 and a valve seat insert 102. The diaphragm valve 100 is supported in and integrally formed with a tapered dispensing tube 104. The tapered dispensing tube 104 allows a larger amount of product to be dispensed by squeezing the tube with some type of dispensing actuator than an untapered tube of the same length. The tapered tube 104 is also injection molded integrally with the valve to reduce the number of assembly steps.

The valve seat insert 102 includes a main body 106 having a tapered shape which fits within an interior of the tapered dispensing tube 104. A valve seat 108 is supported by axial ribs 110 within the main body 106. The valve seat 108 according to this embodiment includes a tapered pin 112 as well as a convex lower surface 114 which corresponds in shape to the dome-shape of the diaphragm valve 100 in the closed position of FIG. 9. In the closed position, the valve seat 108 seals the diaphragm valve orifice 116 and prevents the diaphragm valve from moving inward past the closed position to prevent air from being drawn into the fluid product. FIG. 10 illustrates the valve 100 in an open position in which fluid product is dispensed.

Figure 11:
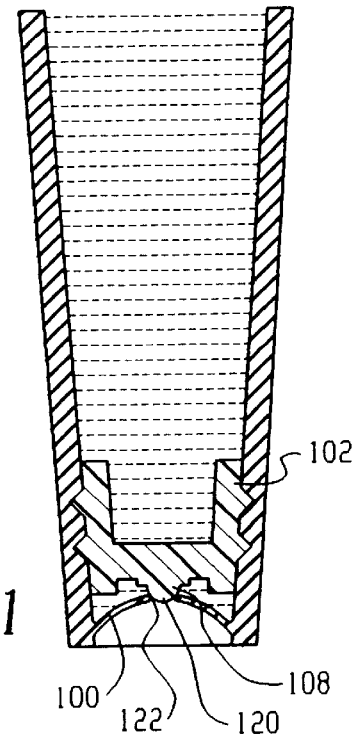
FIG. 11 is a side cross-sectional view of a fourth embodiment of the invention with the dispensing valve in a closed position.
Figure 12:
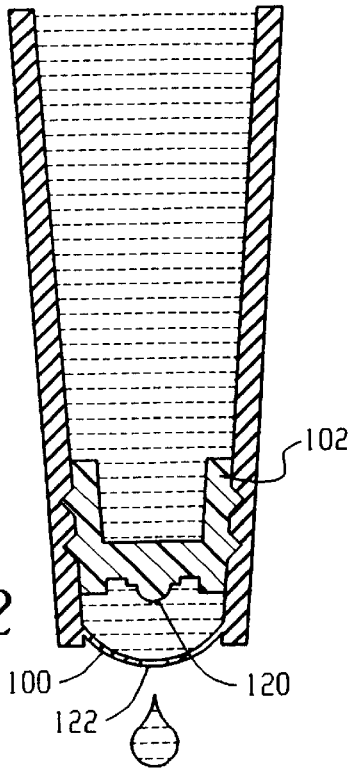
FIG. 12 is a side cross-sectional view of the dispensing valve assembly of FIG. 11 with the dispensing valve in an open position.

FIG. 11 illustrates an alternative embodiment of the dispensing tube and valve assembly in which the valve seat 108 includes a hemispherical portion 120 and the diaphragm valve 100 has a correspondingly shaped discharge orifice 122 which is a circular opening with tapered walls. In the closed position of FIG. 11, the hemispherical portion 120 extends into the discharge opening 122 to seal the discharge opening and prevent air from being sucked back into the fluid product. FIG. 12 illustrates the valve assembly with the hemispherical valve seat 120 and shows the valve 100 in an open position.

Figure 13:
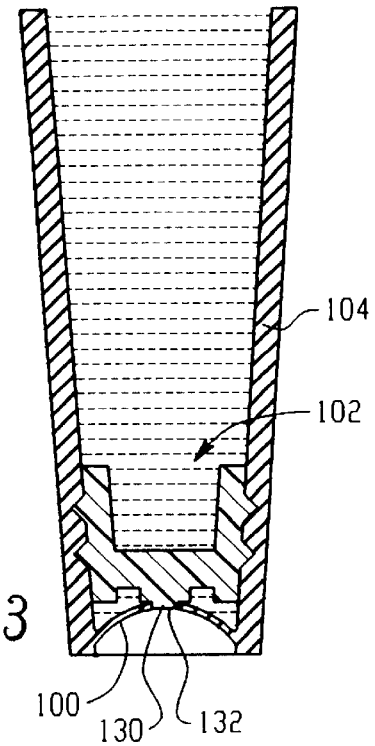
FIG. 13 is a side cross-sectional view of a fifth embodiment of the invention with the dispensing valve in a closed position.

FIG. 13 illustrates a further embodiment of the valve seat insert 102 having a frusto-conically shaped portion 130 on a lower surface of the valve seat 108. A corresponding tapered discharge opening 132 which is wider at an upper surface than a lower surface is received on the frusto-conical shaped portion 130 in a fluid tight seal.

Figure 14:
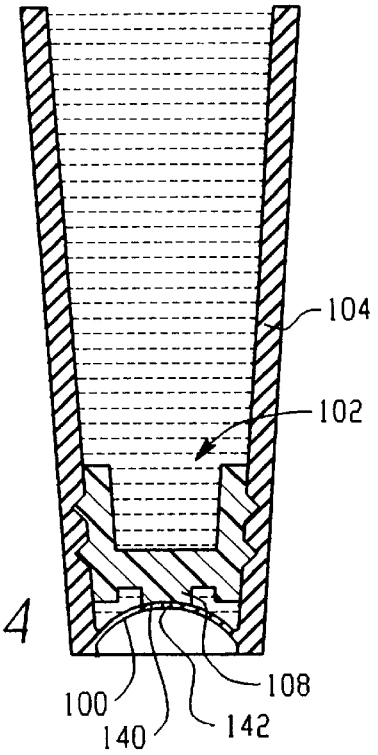
FIG. 14 is a side cross-sectional view of a sixth embodiment of the invention with the dispensing valve in a closed position.
Figure 15:
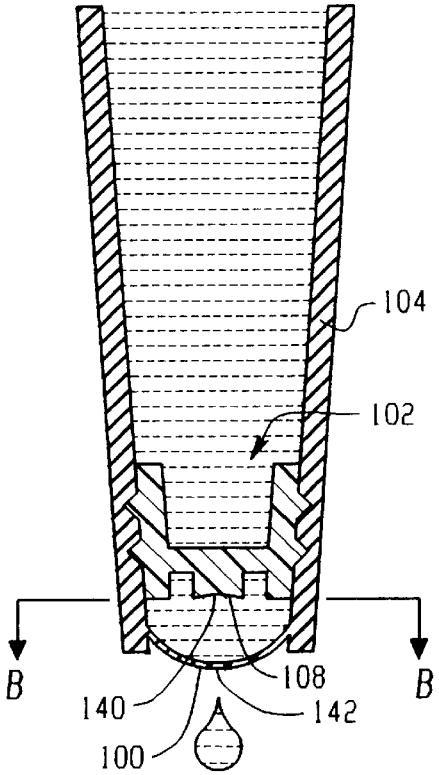
FIG. 15 is a side cross-sectional view of the dispensing valve assembly of FIG. 14 with the dispensing valve in an open position.
Figure 16:
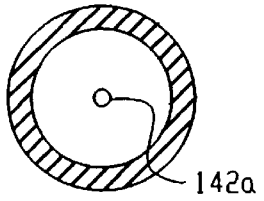
FIG. 16 is a cross-sectional view taken along line B—B of FIG. 15 illustrating a first variation of the invention.
Figure 17:
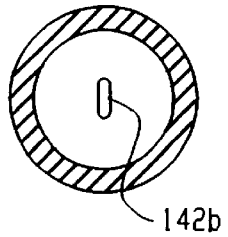
FIG. 17 is a cross-sectional view taken along the line B—B of FIG. 15 illustrating a second variation of the invention.

FIGS. 14 and 15 illustrate an alternative embodiment of a valve seat insert 102 having a valve seat 108 with a concave lower surface 140 which corresponds in curvature to an upper portion of the dome-shaped diaphragm valve 100. As illustrated in FIGS. 16 and 17 which are cross-sectional views taken along line B—B of FIG. 15, the discharge orifice 142 of the diaphragm valve 100 may be either a circular discharge orifice 142*a* or an oval or slit-shaped orifice 142*b*. The discharge orifice 142 may also take on other shapes such as cross-shaped, star-shaped, or arc-shaped.

Figure 18:
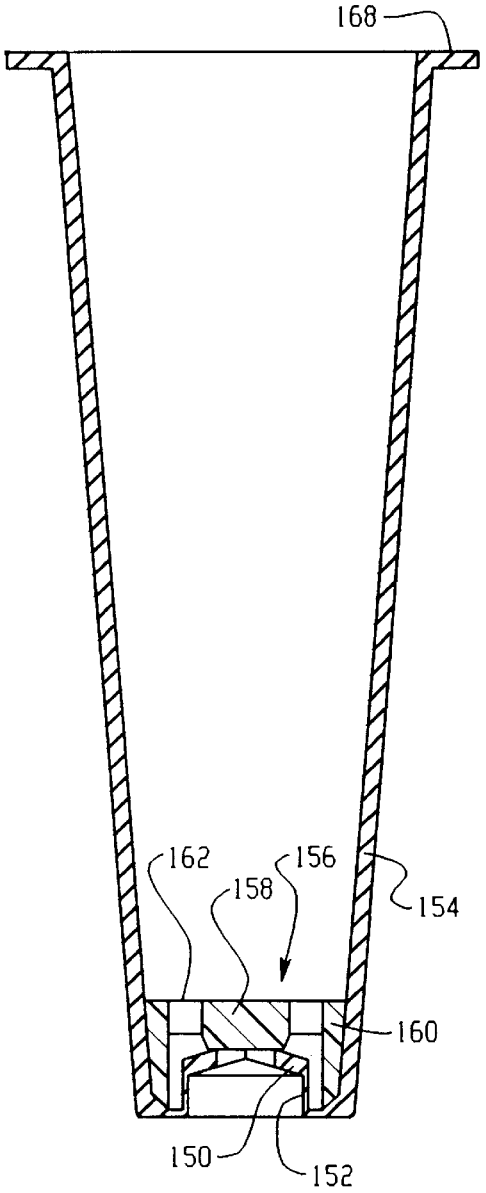
FIG. 18 is a side cross-sectional view of a seventh embodiment of the invention with the dispensing valve in a closed position.
Figure 19:
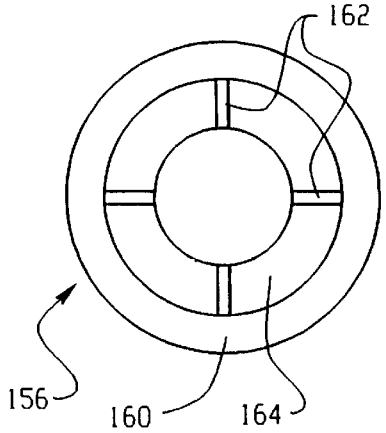
FIG. 19 is a top view of the valve seat insert of FIG. 18.
Figure 20:
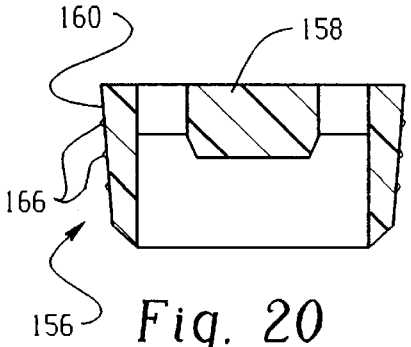
FIG. 20 is a side cross-sectional view of the valve seat insert of FIG. 18.
Figure 21:
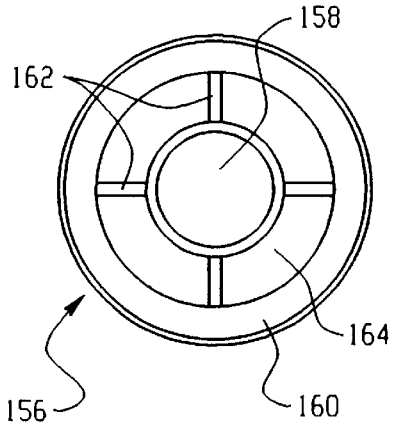
FIG. 21 is a bottom view of the valve seat insert of FIG. 18.
Figure 22:
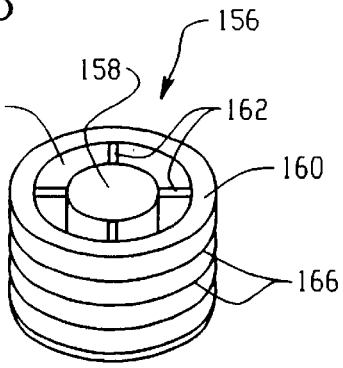
FIG. 22 is a perspective view of the valve seat insert of FIG. 18.

FIGS. 18–27 illustrate variations of support structures for supporting a valve seat adjacent a. flexible diaphragm valve to prevent the diaphragm valve from buckling inward and prevent air from being drawn into the fluid product in the dispenser. FIG. 18 illustrates a dispensing tube and valve assembly having a valve similar to that of FIG. 4 including a valve head 150 and a connector sleeve 152 connecting the valve head to a tapered dispensing tube 154. A flange 168 is provided at an upper end of the dispensing tube 154 for connecting the valve assembly to a dispensing container.

A valve seat insert 156 is inserted into the tapered dispensing tube 154 and positioned such that a valve seat 158 is adjacent the valve head 150 at an inside surface of the valve head. The valve seat insert 156 includes a tapered supporting ring 160 which is configured to fit inside the lower end of the tapered dispensing tube 154. A plurality of axially disposed ribs 162 extend from the supporting ring 160 to support the valve seat 158. Openings 164 between the ribs 162 allows the fluid product to pass through the valve seat insert 156 to the valve. Finally, the valve seat insert 156 includes a plurality of fine ribs 166 or threads on an exterior of the tapered supporting ring 160 which engage an interior surface of the dispensing tube 154 and retain the valve seat insert in place within the dispensing tube.

Figure 23:
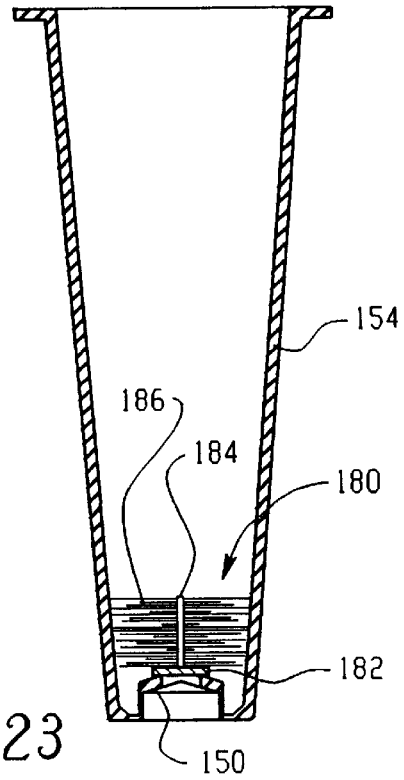
FIG. 23 is a side cross-sectional view of an eighth embodiment of the present invention with the dispensing valve in a closed position.
Figure 24:
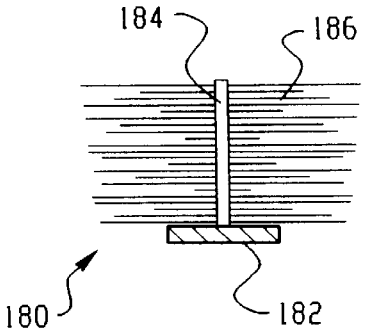
FIG. 24 is a side view of the valve seat insert of FIG. 23.
Figure 25:
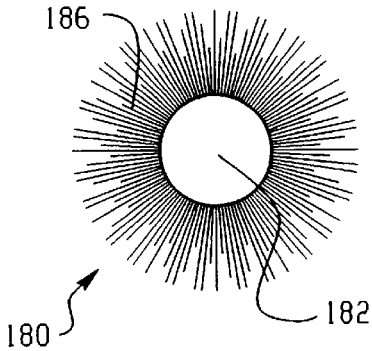
FIG. 25 is a bottom view of the valve seat insert of FIG. 23.

FIGS. 23–25 illustrate an alternative embodiment in which a valve seat insert 180 includes a disk-shaped valve seat 182 mounted within the tapered dispensing tube 154 by a brush-like member formed of a central supporting member 184 and a plurality of axially extending members or wires 186 extending from the supporting member 184. The wires 186 may be formed of any appropriately stiff material such as metal or plastic. The wires 186 supported by the supporting member secure the valve seat insert 180 longitudinally and. axially within the tapered dispensing tube 154 while allowing the fluid product to pass through the valve seat insert. The valve seat 182 abuts the interior surface of the valve head 150 and prevents the valve from buckling inward to allow air to pass into the fluid product.

Figure 26:
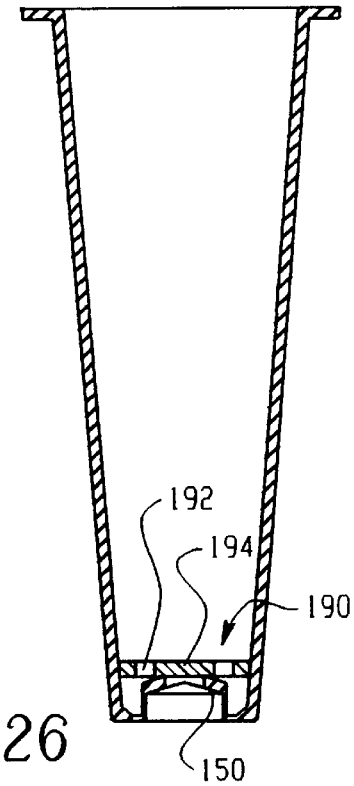
FIG. 26 is a side cross-sectional view of a ninth embodiment of the present invention with the dispensing valve in a closed position.
Figure 27:
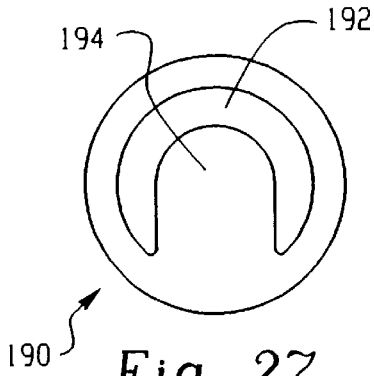
FIG. 27 is a top view of the valve seat insert of FIG. 26.

FIGS. 26 and 27 illustrate an alternative embodiment of a valve seat insert 190 in which the valve seat insert is in the shape of a disk with a U-shaped opening 192 through which the fluid product passes. The U-shaped opening 192 defines the central valve seat 194 which is positioned adjacent the inside surface of the discharge opening of the valve head 150 and prevents the valve head from buckling inward. The central valve seat 194 is connected to the surrounding disk of the valve seat insert 190 by a single supporting member.

Figure 28:
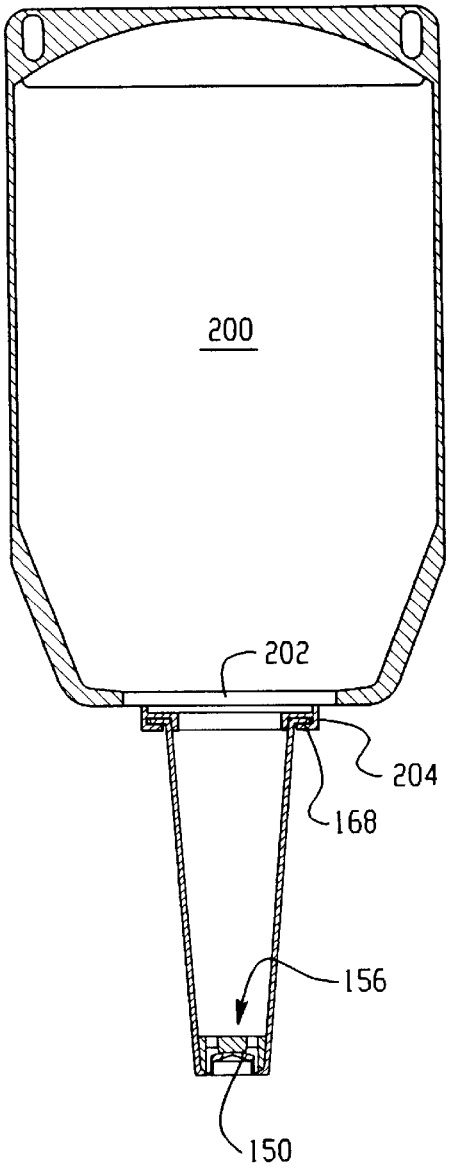
FIG. 28 is a side cross-sectional view of a collapsible container according to the present invention including the valve assembly of FIG. 18.
Figure 29:
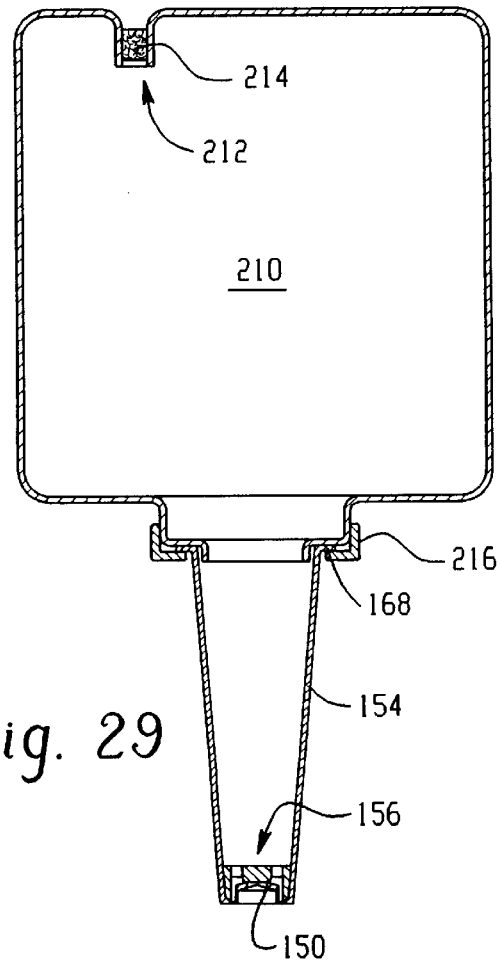
FIG. 29 is a side cross-sectional view of an alternative embodiment of a container according to the present invention including the valve assembly of FIG. 18.

FIGS. 28 and 29 show the valve assembly of FIG. 18 attached to two different dispensing containers for fluid products. A first container 200 of FIG. 28 is a flexible bag or pouch which expands when filled with fluid product. As the fluid product is dispensed from the pouch 200 through the valve head 150, the pouch contracts around the remaining fluid product. The dispensing tube 154 is connected to a base 202 of the pouch 200 by an attachment ring 204 which surrounds the flange 168 of the dispensing tube. The attachment ring 204 is threaded onto the base 202 to capture the flange 168 or alternatively is attached in any other known manner.

A second type of container 210, shown in FIG. 29, is a rigid or semi-rigid container having an air vent 212 and a filter element 214 disposed within the air vent. The filter element 214 may be a HEPA filter or any other type of submicron filter. The fluid product is dispensed from the container 210 by squeezing the container, if the container is semi-rigid, or by squeezing the dispensing tube 154. Air is prevented from being drawn into the container 210 through the valve head 150 by the valve seat but instead enters the container through the filter 214 which removes possible contaminants such as bacteria which would compromise the sterility of the fluid product. The dispensing tube 154 is attached to the container 210 by an attachment ring 216 which traps the flange 168 on the upper end of the dispensing tube.

As illustrated in the various embodiments of the present invention, the particular shape of the fluid discharge opening and the correspondingly shaped valve seat may be varied without departing from the invention. This dispensing orifice can be molded, cut, or punched in the diaphragm valve of various diameters or shapes in order to achieve different amounts of dispensed product over varying activation times and pressures. Although the diaphragm valve is preferably integrally molded with the supporting ring or with the tapered dispensing tube, the diaphragm valve may also be formed separately and secured to the supporting ring in a known manner.

When the dome-shaped diaphragm valve 10, 100 and supporting ring 14 or tapered dispensing tube 104 are integrally molded, the supporting ring or lower portion of the dispensing tube stretches outward slightly to allow the diaphragm valve to buckle between the open and closed positions. The supporting ring 14 or lower portion of the dispensing tube 104 also functions to return the diaphragm to its stable concave shape after activation pressure has been removed.

As illustrated in the various embodiments, the supporting ring may be molded to a straight or tapered flexible tube of the same material as the valve structure which can be compressed causing the discharge of the fluid product. Alternatively, the supporting ring of the valve may be mechanically fixed to an intermediate structure such as the valve seat insert which joins the valve to a flexible, straight, or tapered tube.

The valve seat is positioned so that a lower surface of the valve seat remains in constant contact with the valve in its closed position. According to one preferred embodiment, the lower surface valve seat protrudes slightly into an area that the diaphragm valve would occupy in its naturally relaxed state. This will cause the valve to be forced securely into the valve seat by its desire to always return to its relaxed position.

The invention has been described with reference to the preferred embodiments. Obviously, modifications and alterations will occur to others upon a reading and understanding the preceding detailed description. It is intended that the invention be construed as including all such modifications and alterations insofar as they come within the scope of the appended claims or the equivalents.

Having thus described the preferred embodiment, the invention is now claimed to be:

1. A dispensing valve assembly comprising:

an elongated compressible dispensing tube for dispensing a fluid product from a container by a compression of the tube, the tube being tapered in shape and having a first diameter at a fluid discharge end and a larger, second diameter at a fluid receiving end; and, a flexible rolling valve having a valve opening for dispensing the fluid product from the dispensing tube, the valve being integrally formed with, and positioned within the fluid discharge end of the dispensing tube and extendable from a concave closed position in which the valve extends into an interior of the dispensing tube to a convex open position to dispense the fluid product from the dispensing tube.

2. The dispensing valve assembly as set forth in claim 1 further including:

a suckback preventing valve seat positioned adjacent the valve opening at the interior side of the valve opening when the valve is in the closed position and preventing air from being drawn into the dispensing tube through the valve opening.

3. The dispensing valve assembly according to claim 2, wherein the valve seat is mounted within the dispensing tube by a support structure which allows the fluid product to pass through the support structure and around the valve seat when the valve in the opened position.

4. The dispensing valve assembly according to claim 2 wherein the valve seat includes a valve seat support structure and a first end of the valve seat support structure is received inside the fluid discharge end of the dispensing tube.

5. The dispensing valve assembly according to claim 1, wherein the tube is a plurality of times longer than the larger diameter.

6. The dispensing valve assembly according to claim 5, further including:

a means for preventing the rolling valve from drawing air into the tube to replace discharged fluid.

7. The dispensing value assembly according to claim 6, further including:

a connector at the fluid receiving end of the tube for interconnecting the fluid receiving end of the tube with the container.

8. A combination dispensing valve assembly and fluid container comprising:

a container body having a fluid product outlet;

a valve assembly connected to the outlet for selectively dispensing the fluid product, the valve assembly including:

an elongated compressible dispensing tube connected with the container outlet for dispensing a fluid product from the container body by compression of the tube, the tube being tapered in shape and having a first diameter at a fluid discharge end and a larger, second diameter at the container body outlet; and, a flexible rolling valve having a opening for dispensing the fluid product from the dispensing tube, the valve being integrally formed with, and positioned within the fluid discharged end of the dispensing tube and extendable from a concave closed position in which the valve extends into an interior of the dispensing tube to a convex open position to dispense the fluid product from the dispensing tube.

9. The combination dispensing valve assembly and container according to claim 8, further comprising a suck back preventing means for sealing the rolling valve opening when the rolling valve is in the closed position to prevent air from being drawn into the container body.

10. The combination dispensing valve assembly and container according to claim 9, wherein the suck back preventing means includes:

an air vent communicating between an interior and an exterior of the container body to allow air to pass into the container body to return the container body to an equilibrium state after the fluid product has been dispensed.

11. The combination dispensing valve assembly and container according to claim 9, wherein the suck back preventing means includes:

a sealing member positioned adjacent an interior of the valve opening, and a connecting member supporting the sealing member and allowing the fluid product to pass around the sealing member when the rolling valve is in the open position.

12. The combination dispensing valve assembly and container according to claim 10, wherein the air vent includes a filter element which filters contaminants from air entering the interior of the container body through the air vent.

13. The combination dispensing valve assembly and container according to claim 8, wherein the dispensing tube is tapered inward from the dispensing opening to the valve and wherein the dispensing tube is compressed by a dispensing actuator.

14. The combination dispensing valve assembly and container according to claim 8, wherein the container body is a flexible pouch which collapses as the fluid product is dispensed.

15. The combination dispensing valve assembly and container according to claim 8, wherein the tube has a length which is a plurality of times its diameter.

* * * * *